US006858249B2

(12) United States Patent
Zschaeck

(10) Patent No.: US 6,858,249 B2
(45) Date of Patent: Feb. 22, 2005

(54) METHOD AND DEVICE FOR APPLYING HIGH VISCOSITY LIQUIDS

(75) Inventor: Michael Zschaeck, Munich (DE)

(73) Assignee: Beiersdorf AG, Hamburg (DE)

( * ) Notice: Subject to any disclaimer, the term of this patent is extended or adjusted under 35 U.S.C. 154(b) by 38 days.

(21) Appl. No.: 10/277,710

(22) Filed: Oct. 22, 2002

(65) Prior Publication Data

US 2003/0091744 A1 May 15, 2003

Related U.S. Application Data

(63) Continuation of application No. PCT/EP01/03869, filed on Apr. 5, 2001.

(30) Foreign Application Priority Data

Apr. 22, 2000 (DE) ..... 100 20 102

(51) Int. Cl.[7] ..... B05D 5/10; B05C 3/18

(52) U.S. Cl. ..... 427/207.1; 427/356; 427/359; 427/428; 427/358; 118/641; 118/406; 118/410; 118/415

(58) Field of Search ..... 427/207.1, 356, 427/359, 428, 358; 118/302, 325, 406, 410, 415, 641

(56) References Cited

U.S. PATENT DOCUMENTS

| | | | | |
|---|---|---|---|---|
| 3,921,521 A | * | 11/1975 | Kudlich | 101/120 |
| 4,671,205 A | | 6/1987 | Billeter | |
| 4,911,948 A | | 3/1990 | McIntyre | |
| 4,938,835 A | | 7/1990 | Ludwig | |
| 5,053,254 A | | 10/1991 | Billeter | |
| 5,122,219 A | | 6/1992 | Ludwig | |
| 5,250,320 A | * | 10/1993 | Suzuki et al. | 427/128 |
| 5,667,618 A | | 9/1997 | Lowther | |
| 6,196,127 B1 | | 3/2001 | Yamamoto et al. | |
| 2003/0091744 A1 | | 5/2003 | Zschaeck | |

FOREIGN PATENT DOCUMENTS

| | | |
|---|---|---|
| CH | 648497 | 3/1985 |
| EP | 195099 A1 | 9/1986 |
| EP | 0805048 A1 | 11/1997 |
| GB | 1324966 | 7/1973 |

OTHER PUBLICATIONS

International Search Report from corresponding International Application No. PCT/EP01/03869, dated Sep. 27, 2001.

* cited by examiner

*Primary Examiner*—Katherine A. Bareford
(74) *Attorney, Agent, or Firm*—Alston & Bird LLP

(57) ABSTRACT

Method for partially applying high viscosity liquids to a supporting material whereby the liquid is applied by means of a nozzle which opens into an orifice, and is extruded through a screen on to the supporting material, which rests on a pressure-resistant substrate, but distinguished by the geometry of the nozzle being so arranged that the nozzle outlet slit opens into an orifice which feeds the liquid to the screen, and in that orifice an increase of pressure in the liquid is generated so that the pressure in the liquid at the nozzle orifice is higher than the pressure in the nozzle outlet slit.

26 Claims, 2 Drawing Sheets

METHOD AND DEVICE FOR APPLYING HIGH VISCOSITY LIQUIDS

CROSS-REFERENCE TO RELATED APPLICATIONS

This is a continuation application of PCT/EP01/03869, filed Apr. 5, 2001, which is incorporated herein by reference in its entirety, and also claims the benefit of German Priority Application No. 100 20 102.4, filed Apr. 22, 2000.

FIELD OF THE INVENTION

The invention relates to a method for partially applying high viscosity liquids to a supporting material whereby the liquid is applied by means of a nozzle which opens into an orifice, and is extruded through a screen on to the supporting material, which rests on a pressure-resistant substrate.

BACKGROUND OF THE INVENTION

It is known that in the field of medicine there are substrates which are coated with high viscosity materials. For certain purposes it is sensible that these coatings do not generate a sealed surface but are applied as dots, which for instance allows sweat and other elimination products to escape from skin under bandages and not cause maceration. An adequate method of achieving this dotted coating is offered by rotational screen extrusion.

In this method a rotating screen has a nozzle located inside it, and through the nozzle the liquid that is to be applied is brought from outside to inside the screen. It is then extruded out through the holes in the screen in the direction of the substrate that is to be coated. Dependent on the substrate transport speed (rotational speed of the screen drum), the screen is lifted up by the substrate. Depending on the adhesion and internal cohesion of the liquid, the slugs which have already swelled so as to adhere to the supporting material draw out the limited stock of hot melt adhesive in the hole to a sharp contour, assisted by the sustained extrusion pressure, on to the supporting material.

On completion of this transport there forms, depending on the rheology of the liquid, over the pre-determined basis area a more or less heavily crumpled domed surface of the slug. The height to base ratio of the slug depends on the hole diameter to drum screen wall thickness ratio, and on the physical characteristics (flow behavior, surface tension and wetting angle on the supporting material) of the liquid.

Regarding substrate materials many types are prescribed and have been used in practice, including films, woven fabrics, knitted textiles, fleeces, gels and foams. In the medical sector there are particular requirements for the supporting materials. The materials must be compatible with the skin, generally permeable to air and/or water, easily formed and ductile. Based on these requirements, often the thinnest and weakest supporting material is preferred. For handling and use the supporting material must however be sufficiently strong and if necessary have only a limited tendency to stretch. Furthermore the supporting material should exhibit sufficient strength and limited tendency to stretch, even when wet through. It is known within the textile industry that partial coatings can be transferred. EP 0 675 183 A1 describes a method for transferring melt adhesive geometries on to a specially cross-linked substrate. In EP 0 356 777 A1 also mentions a non-adhering intermediate support medium. Also the use of a coated counter-pressure roller as auxiliary medium for the transfer is described (CH 648 497 A5), although here the process does not refer to self-adhesive products.

The transfer especially of high viscosity liquids such as thermoplastics from the counter-pressure roller on to an introduced supporting material is subject under current technology using thermo-screen extrusion to very severe restrictions, because the plastic-coated flexible counter-pressure rollers have coating thicknesses in the range 10 to 20 mm, the thermal insulation effect of which makes it difficult to cool down the thermoplastic on the circumference of the roller. This means that the cohesion of the slugs necessary to overcome the adhesion to the roller can be attained only at very low process speeds.

The arrangement of nozzle and screen are described in essentials in CH 648 497 A5, improvements to the method are described in EP 0 288 541 A1, EP 0 565 133 A1, EP 0 384 278 A1 and DE 42 31 743 A1.

The method requires that the liquid be applied with a pressure sufficiently high for extrusion from the screen holes. Pressures of the order of between 5 and 30 bar are necessary for this, depending on the hole diameter of the screen, the viscosity of the liquid and the processing speed. Until now the method has been to generate this pressure by upstream devices. The consequence of this is that the entire nozzle area including even the rotary seals at the sides of the rotating assembly are also subjected to this high pressure. The seal is provided by flexible lip seals (as wiper blades in CH 648 497 A5) or by nozzle lips adapted to the curvature of the screen profile (EP 0 565 133; U.S. Pat. No. 5,122,219).

Furthermore the counter-pressure rollers used are exclusively plastic-coated flexible type (CH 648 497 A5, EP 0 565 133 A1).

The transfer described above of especially of high viscosity liquids such as thermoplastics from the counter-pressure roller on to an introduced supporting material is subject under current technology using thermo-screen extrusion to very severe restrictions, because the plastic-coated flexible counter-pressure rollers have coating thicknesses in the range 10 to 20 mm, the thermal insulation effect of which makes it difficult to cool down the thermoplastic on the circumference of the roller. This means that the cohesion of the slugs necessary to overcome the adhesion to the roller can be attained only at very low process speeds.

A particularly advantageous process feature has until now been seen to be that the center-to-center spacing between screen and counter-pressure roller should be maintained at less than the total of the radii (EP 0 565 133 A1, DE 42 31 743 A1), so that positive pressure is generated.

There is a limit to the force between the rotating screen at the sealing zone of the nozzle and the counter-pressure roller, since excessive force will cause the risk of mechanical damage or excessive wear, so that the liquid pressures necessary for extrusion coating lead in practice to the well known problems of leakage in the nozzle/screen system.

SUMMARY OF THE INVENTION

The purpose of this invention is to make available a method that is outstandingly suitable for applying high viscosity liquids on to a supporting material whilst avoiding the disadvantages inherent in present technology.

This purpose has been achieved by a method that is described in the main application. The subsidiary applications apply to advantageous extensions of the invention.

Accordingly the invention describes a method for partially applying high viscosity liquids to a supporting material whereby the liquid is applied by means of a nozzle which opens into an outlet slit, through a screen on to the supporting material, which rests on a pressure-resistant substrate. The geometry of the nozzle is so arranged that the nozzle outlet slit opens into an orifice which feeds the liquid to the screen, and in that orifice an increase of pressure in the liquid is generated so that the pressure in the liquid at the nozzle orifice is higher than the pressure in the nozzle outlet slit.

Furthermore it is advantageous that the liquid in the orifice of the outlet slit is accelerated to move predominantly normal to the screen.

The key of the method is that the orifice of the nozzle outlet slit, which feeds the liquid to the screen, generates an intensification of pressure and an increase in the flow velocity of the liquid in comparison to the pressure and flow rate and direction of the liquid in the preceding space.

It is a further advantage that the screen is in the form of a cylindrical drum, so that the process is one of rotation extrusion.

The nozzle that feeds the liquid to the screen is designed as follows for best advantage:

The forward edge of the nozzle orifice in the direction of rotation is in the form of a lip, which for instance comprises a cuboid tool, which in the longitudinal sense matches the length of the nozzle and in the transverse sense is a flat land, continuing into a rising curve towards the screen and then after a corresponding length reaches the line of the screen, at which point it takes up a curve with the radius of curvature of the screen. This flat land in the lip forms an angle to the screen tangent at the screen/lip contact point, and the intersection of the lines of that angle is in the direction of rotation of the screen.

A lip constructed in this way allows a surprising degree of intensification of the pressure in the extrusion zone of the liquid through the screen and increases the extrusion speed of the liquid through the screen holes, without requiring any increase of pressure in the feed system to the nozzle or within the nozzle itself. The increases in extrusion speed of the liquid allows production speed to be increased without any reduction in the weight applied per area.

The design of the lip is with best advantage when

- the flat land forms an angle with the screen tangent which lies between 0.5° and 25°, and especially between 1° and 10°,
- the flat land has a length of 2 to 30 mm, preferably from 3 to 10 mm,
- the ratio of the length of the stretch called the flat land to the length of the curved rise of 1:1 to 20:1, and advantageously 3:1 to 10:1,
- and the curved rise has a radius between 1 mm and 100 mm, and advantageously 20 to 60 mm.

Particularly advantageous is further the design where the face of the lip to the contact point between screen and lip in the direction of rotation is adapted in a radius to the curvature of the screen, forming an arc of 2 to 10 mm long, and preferably 2 to 5 mm long.

A design by which the ratio of the length of the stretch called the flat land to the length of the curved rise tends to infinity also offers advantages.

Variations across the width of the substrate in the quantity of liquid deposited at constant screen parameters can in a further advantageous version be achieved that the face over the length of the nozzle transverse to the direction of rotation can form an differing angle with the screen, whereby the transitions between the zones of differing angles can be either abrupt or continuously gradual.

The lip lying against the direction of rotation of the screen (rear lip) is also made as a separate tool and provided with its own flat land. Its inclination corresponds to the angle that the tangent to the opposite screen section forms with the horizontal. For best advantage the version exhibits an extension in the direction of rotation of 1 to 10 mm, preferably of 2 to 5 mm.

In a special designed form of the coating nozzle the geometry described for the forward or rear lip or for both lips can be made not as separate tools but integral to the coating head.

A further advantage is that the extrusion of the liquid through the screen is supported by a thermal or rheologically driven viscosity reduction, for instance by an increase in temperature or by introduction of shear energy. So as to avoid further disadvantages, it is particularly advantageous that this is done only in the area where the liquid is extruded through the screen.

In a special design form the screen for this is exclusively or additionally heated with further heater element in the circular arc segment, where the extrusion of the liquid is taking place and which covers an angle of up to 180°, preferably from 5° to 90° in relation to the center of the screen and which is arranged in the direction of rotation of the screen before, after or both sides of the point where the extrusion of the liquid is taking place. This can for instance be implemented using one or more heater plates.

The method thus described is advantageous for applying coatings with liquids that have a dynamic null viscosity of 0.1 to 1000 Pas, preferably with a dynamic null viscosity of 1 to 500 Pas.

Suitable liquids include as well as fluid inorganic and organic compounds, also dispersions, emulsions, solutions and melts. For coating supporting material with subsequent medical, cosmetic or technical applications, it is preferable to use adhesives, and particularly preferable to use self-adhesives. It is preferable that these belong to the materials classes of solutions, dispersions, pre-polymers and thermoplastic polymers.

It is advantageous to use thermoplastic hot-melt adhesives based on natural and synthetic rubbers and on other synthetic polymers such as for example acrylates, methacrylates, polyurethanes, polyolefins, polyvinyl derivatives, polyesters or silicones, with corresponding additional materials such as adhesive resins, plasticisers, stabilisers and other additives as required.

Their softening point should be higher than 50° C., the application temperature is generally at least 90° C. and preferably between 100° C. and 180° C., or between 180° C. and 220° C. in the case of silicones. Where necessary a post-application cross-linking by means of UV or electron beam radiation can be applied, to achieve particularly advantageous characteristics in the hot melt adhesive.

In particular, hot melt adhesives based on block copolymers exhibit a multitude of variation possibilities, since targeted reduction of the glacial transition temperature of the self-adhesive as a consequence of selection of the tack agent, the plasticiser, the polymer molecule size and the molecular weight distribution of the composition components ensures the required functionally appropriate adhesive properties to the skin, even at critical points in the human mobility structure.

For particularly strongly adhesive systems, the hot melt adhesive preferred is based on block copolymers, especially A-B-, A-B-A- block copolymers, or mixtures thereof. The hard phase A is predominantly polystyrene or its derivates, and the soft phase B contains ethylene, propylene, butylene, butadine, isoprene or mixtures thereof, with particular preference for ethylene and butylene or mixtures thereof.

Polystyrene blocks however can also be included in the soft phase B, up to 20% by weight. The total styrene content should however always remain below 35% by weight. Preferably the styrene proportion should be between 5% and 30% by weight, since a lower styrene proportion causes the adhesive to be more ductile.

In particular the targeted mixing of di-block and tri-block copolymers is advantageous, for which it is preferable for the proportion of di-block copolymer to be less than 80% by weight.

In an advantageous arrangement the hot melt adhesive will exhibit the following composition:

| | |
|---|---|
| 10% to 90% by weight | block copolymers, |
| 5% to 80% by weight | Tack agents such as oils, waxes, resins and/or mixtures therefore, preferably mixtures of resins and oils, |
| less than 60% by weight | plasticisers, |
| less than 15% by weight | additives, |
| less than 5% by weight | stabilisers. |

The aliphatic or aromatic oils, waxes and resins that serve as tack agents are preferably hydrocarbon oils, waxes and resins, of which oils such as paraffin hydrocarbon oils or waxes such as paraffin hydrocarbon waxes due to their consistency have the best effectiveness for adhesion to the skin. As plasticisers, medium or long chain fatty acids and or esters are used. These additives serve also to adjust the tackiness characteristics, and the stability. Where necessary, further stabilisers and other additives are used.

The adhesive can be filled out with mineral fillers, fibers, micro bubbles or micro spheres.

In particular for medial supporting materials the requirements for adhesive properties are high. For an ideal application the hot melt adhesive should have high initial adhesion. The functionally adjusted tack on the skin and on the back of the support material should be present. Furthermore, so that no wrinkling occurs, a high shear strength is also necessary in the hot melt adhesive. The necessary functionally appropriate adhesion to the skin and to the back of the support material is achieved by targeted reductions in the glacial transition temperature as a consequence of the selection of the tack agent, the plasticiser, the polymer molecular size and molecular distribution of the components used. The high shear strength of the adhesive is achieved due to the high cohesiveness of the block copolymers. The good initial adhesion is generated by the palette of tack agents and plasticisers employed.

Product characteristics such as initial adhesion, glacial transition temperature and shear stability can be will quantified by dynamic mechanical frequency measurement. For this a rheometer with shear stress control is used. The results of the measurement method give information regarding the physical characteristics of a material by measuring the visco-elastic component. For this at a pre-selected temperature the hot melt adhesive is placed between two plane parallel plates and is vibrated at variable frequencies and small deformations (within the linear visco-elastic range). The mountings are computer-linked and the quotient (Q=tan δ) between the losses module (G" viscous component) and the retention module (G' elastic component) is determined $$Q=\tan\delta=G''/G'$$

For subjective assessment of the tack, a high frequency is selected, and the for shear strength a low frequency. Higher value numbers indicate better initial tack and poorer shear stability.

The glacial transition temperature of the temperature at which the amorphous or partially crystalline polymers switch over from liquid or rubber elastic state into hard elastic or glacial state, and vice versa (Römpp Chemie-Lexikon, 9th edition, volume 2, page 1587, Georg Thieme Verlag Stuttgart—New York, 1990). It corresponds to the maximum temperature function for a particular frequency. Particularly for medical applications, a relatively low glacial transition temperature is necessary.

| Description | $T_G$ low frequency | Ductility low frequency/RT | Initial tack high frequency/ RT |
|---|---|---|---|
| Hot melt adhesive A | −12 ± 2° C. | tan δ = 0.32 ± 0.03 | tan δ = 1.84 ± 0.03 |
| Hot melt adhesive B | −9 ± 2° C. | tan δ = 0.22 ± 0.03 | tan δ = 1.00 ± 0.03 |

It is advantageous that hot melt adhesives are adjusted so that at a frequency of 0.1 rad/s they have a dynamic-complex glacial transition temperature of lower than 15° C., preferably between 5° C. and −30° C., with special preference for between −3° C. and −15° C.

If is found preferable that hot melt adhesives at a frequency of 100 rad/s at 25° C. should have a ratio of viscous component to elastic component greater than 0.7, and specially preferred between 1.0 and 5.0, and at a frequency of 0.1 rad/s at 25° C. should have a ratio of viscous component to elastic component less than 0.6, and specially preferred between 0.4 and 0.02.

The rounded or polygeometrical body forms can take various forms. The preference is for flattened hemispheres. However other forms and patterns can be extruded on to the supporting material, for instance in the image of an alphanumeric character, or patterns such as grids, strips, concentrations of slugs and zig-zag lines.

The adhesive can be evenly distributed on the supporting material, or if functionality so requires can be distributed over the surface at differing strengths or densities, which it is found can be improved by varying the angle between the supporting material and the screen.

All rigid and elastic surface forms of synthetic and natural materials are suitable as supporting materials. Preferably supporting materials should be chosen according to the application of the adhesive, so that technical requirements or characteristics of a functionally satisfactory dressing. Examples are textiles such as woven materials, knitted materials, stacked materials, fleeces, laminates, foams and papers. Furthermore, these materials can be pre-processed or post-processed. Usual pre-processing are corona and waterproofing; usual post-processing is calandering, malleablizing, backing, punching and covering.

In particular when directly coating a supporting material it must exhibit a certain strength and tightness so as to prevent during the process of coating the slugs penetrating too far into the supporting material or even penetrating clean through it.

In a preferred version of the method during the invention the slugs and/or polygeometrical body forms were passed on to a second supporting material, after initial application of the coating. The second supporting material in this case is the real supporting material, the first supporting material acts only as an auxiliary supporting material. Such an auxiliary supporting material can also take the form of a non-adhering roller or belt.

A preferred version of the auxiliary supporting material is a roller with non-adhering surface, where the non-adhering surface of the roller is of silicone or fluorine-containing compound, or plasma-coated separation system. These can be in the form of a coating with a surface density of 0.001 $g/m^2$ to 3000 $g/m^2$ preferably 100 $g/m^2$ to 2000 $g/m^2$.

When performing the method it is desirable that the non-adhering surface of the roller is set to a temperature between 0° C. and 200° C., preferably lower than 60° C., and specially preferably lower than 25° C. This is particularly advantageous if the non-adhering characteristics of the surface of the roller are so constituted that the adhesive applied is self-adhesive even to a cooled roller (<25° C.).

Also a post-processing calandering of the coated product and/or a pre-treatment of the supporting material such a corona bombardment, can be advantageous for better anchoring of the adhesive layer.

Further more a treatment of the hot melt adhesive with an electron radiation cross-linking post-process or a UV radiation can lead to improvement in the desired characteristics.

It is preferable that the supporting material is coated at a rate greater than 2 m/min, and preferably 20 to 200 m/min.

The proportion of the surface that is coated with hot melt adhesive should be a minimum of 1%, and can be up to about 99%, for special products 15% to 95% is preferable, with 550% to 95% specially preferable. This can where necessary be achieved by multiple passes, whereby where necessary also hot melt adhesives with different characteristics can be applied.

Partial application allows controlled channels for dissipation of trans-epidermal water losses and improves evaporation from the skin when sweating, particularly if supporting materials permeable to air and water are used. This also avoids irritations of the skin that may be occasioned by an accumulation of bodily fluids. The dissipation channels operate to disperse water even when multiple layers of bandages are applied.

In a preferred version form of the invented method, such a supporting material exhibited an air pass-through rate greater than 1 $cm^3/(cm^2*s)$, preferably 10 to 150 $cm^3/(cm^2*s)$, and a water pass-through rate greater than 200 $g/(m^2*24\ h)$, preferably 500 to 5000 $g/(m^2*24\ h)$.

In a further preferred version form in accordance with the invention method, the supporting material exhibited an adhesion to steel on the back face of the supporting material of at least 0.5 N/cm, and especially an adhesion force between 2 N/cm and 20 N/cm.

Depilation of the relevant area of the body and the mass transfer to the skin can be dispensed with due to the high cohesiveness of the adhesive, because the adhesive does not anchor to skin and hair, rather the anchoring of the adhesive to the supporting material is up to 20 N/cm (test piece width) which is good for medical applications.

The intentional break points in the coating mean that skin is no longer pushed together or against itself on stripping. The non-displacement of skin and the low depilation lead to a freedom from pain not previously encountered for such strongly adhesive systems. Furthermore the individual biomechanical adhesion force control, which exhibits a proven reduction on the adhesive force of this plaster, supports ease of removal. The applied supporting material shows good proprio-receptive effects.

In a further advantageous version the self-adhesive is foamed before application to the supporting material.

For this the self-adhesive is foamed preferably with passive gases such as nitrogen, carbon dioxide, inert gases, hydrocarbons or air, or mixtures thereof. In many cases foaming by thermally-decomposing gas evolution agents such as azo compounds, carbonate compounds and hydrazine compounds have been found to be suitable.

The degree of foaming, i.e. the proportion of gas, should be at least 5% by volume and can reach up to 85% by volume. In practice, values between 10% by volume and 75% by volume, preferably 50% by volume have proven successful. When processed at relatively high temperatures of about 100° C. and comparatively high internal pressures, there arise very open-pored adhesive foam coatings, which are particularly good for air and water permeability. The advantageous characteristics of foamed self-adhesive coatings such as low consumption of adhesive, high initial tack and good ductility even on irregular surfaces due to the elasticity and plasticity and the initial tack mean that it is the optimum technique in some very special areas of medial products.

By the use of active breathing coatings in connection with elastic and also active breathing supporting materials, the user senses subjectively more comfort in wearing the bandage.

A particularly suitable method for production of foamed self-adhesives operates on the foam-mix system. For this the thermoplastic self-adhesive is transformed in a stator/rotor system under high pressure at a temperature above the softening point into a mixture with gases provided such as for example nitrogen, air or carbon dioxide in various volumetric proportions (about 10% by volume up to 80% by volume).

Whilst the gas pre-pressurization is higher than 100 bar, the gas/thermoplastic mixture pressure in the system is between 40 and 100 bar, preferably between 40 and 70 bar. The adhesive foam thus generated can then be fed by a pipe into the extrusion nozzle.

Due to the foaming of the self-adhesive and the resulting open pores in the mass together with use of a porous supporting material, the product with its adhesive coating has good water vapor and air permeability. The necessary adhesive mass quantity is substantially reduced without compromising the adhesiveness properties. The adhesive mass exhibits a surprisingly high tack, since per gram of mass more volume for wetting the base material on to which it is to be stuck is available, and the plasticity of the adhesive mass is enhanced by the foam structure. Also the anchoring on to the supporting material is improved by this means. Apart from this the foamed adhesive coating lends the product a soft an pleasant feel, as mentioned above.

Foaming generally causes the viscosity of the adhesive mass to be reduced. This means that the energy of melting is reduced, and even thermally unstable supporting materials can be directly coated.

The outstanding characteristics of the supporting materials coated with self-adhesive in accordance with the invention lay the basis for use for medical products, particularly plasters, medical fixtures, wound coverings, doped systems, in particular for such which release substances near orthopedic or phlebological bandages.

Finally the supporting material after the coating process can be covered with a non-adhering supporting material such as siliconized paper, or can be provided with a wound dressing or padding.

Particularly advantageous is that if the supporting material can be sterilized, gamma sterilization is preferred. Particularly suitable for post-process sterilization are hot melt adhesives based on block copolymers, which contain no double bonds. This applies particularly for styrene-butylene-ethylene-styrene block copolymerisates or styrene-butylene-styrene block copolymerisates. No changes to the adhesive characteristics relevant to the application arise from this.

This is outstandingly suitable for technically reversible fixings, which on removal are not permitted to injure or damage various underlying materials such as paper, plastic, glass, textiles, wood, metals or minerals.

Finally, technically permanent adhesion bonds can be produced which only by partial splitting of the underlying material can be separated.

BRIEF DESCRIPTION OF THE DRAWINGS

Several charts can be presented showing the advantageous version forms of the subject of the invention, without intending to unnecessarily set bounds to the scope of the invention.

They show.

DETAILED DESCRIPTION OF THE PREFERRED EMBODIMENTS

Figure 1:
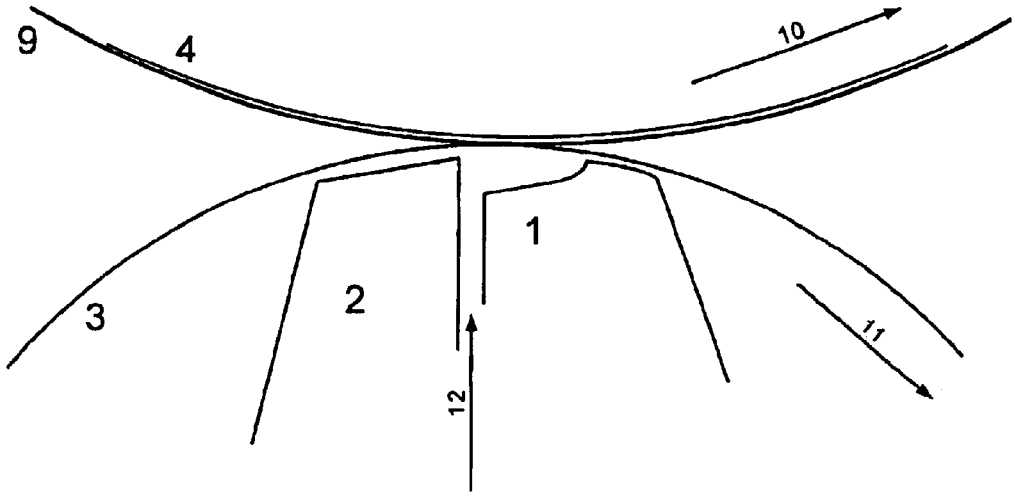
FIG. 1 a section of an extrusion coating unit, which operates in accordance with this invention, FIG. 2 the nozzle lip that is in the direction of rotation of the screen, formed as a combination of flat land and upward curve.

FIG. 1 shows a section of an extrusion coating unit, which operates in accordance with this invention. The supporting material 9 is fed through the gap between the screen 3 (direction of rotation 11) and the counter-pressure roller 4 (direction of rotation 10). The liquid extruded through screen 3 coats the supporting material 9. The liquid flows from the slit (direction of flow 12) between the forward (in the direction of rotation) nozzle lip 1 and the rear nozzle lip 2. Due to the special geometry of the forward nozzle lip 1 in accordance with the invention an intensified pressure and a change in direction of flow of the liquid take place.

Figure 2:
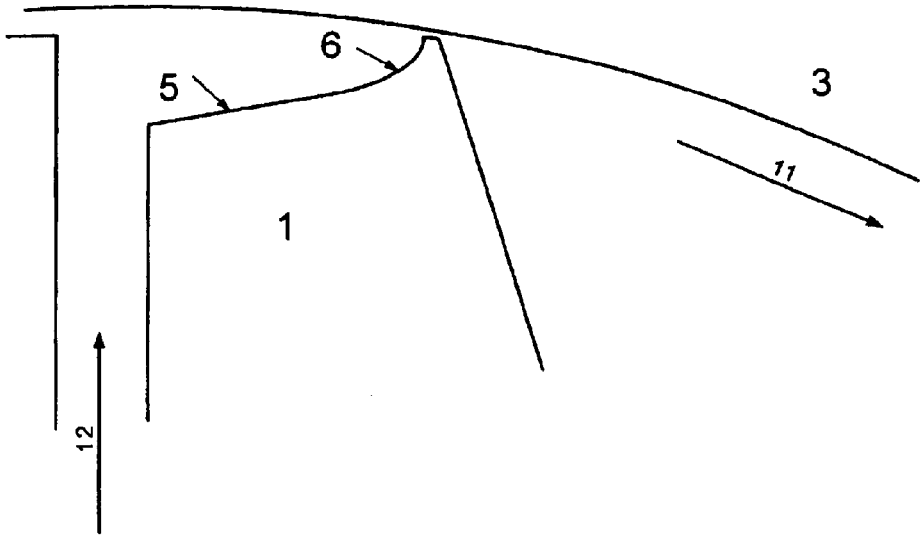

FIG. 2 shows nozzle lip 1, which is in the direction of rotation of the screen, formed as a combination of flat land 5 and upward curve 6.

Figure 3:
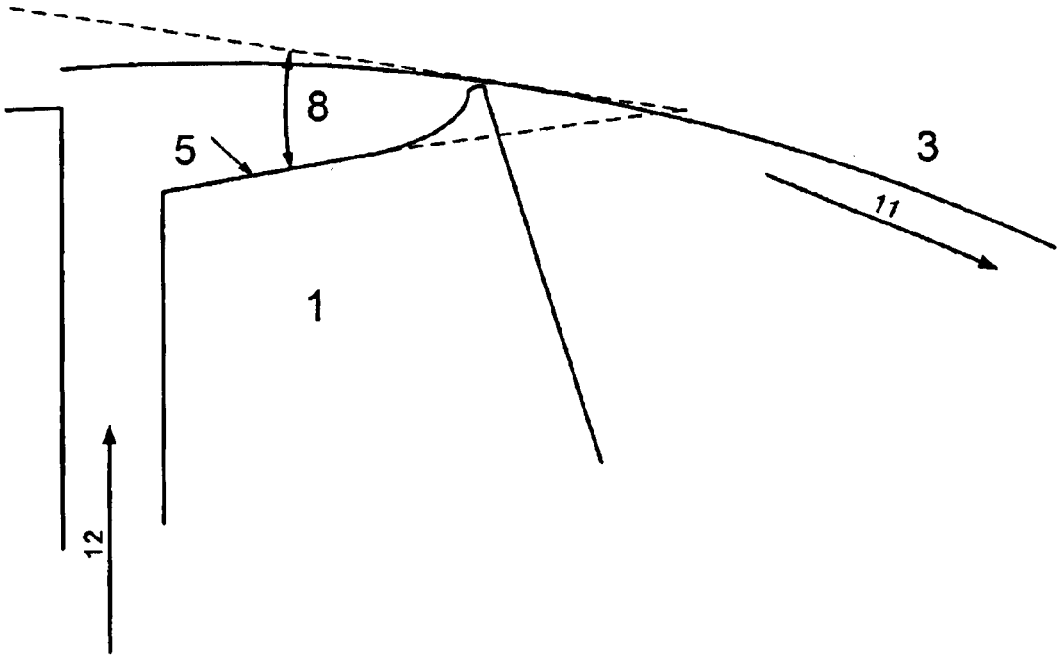
FIG. 3 the nozzle lip that is in the direction of rotation of the screen, formed as a combination of flat land and upward curve, showing angle formed between the flat land and the screen and FIG. 4 the nozzle lip that is in the direction of rotation of the screen, formed as a combination of flat land and upward curve, whereby additionally the flat land of the lip into the contact zone of lip and screen has a curvature of suitable radius matching the curvature of the screen.

FIG. 3 shows nozzle lip 1, which is in the direction of rotation of the screen, formed as a combination of flat land 5 and upward curve 6, showing angle 8 formed between the flat land and the screen.

Figure 4:
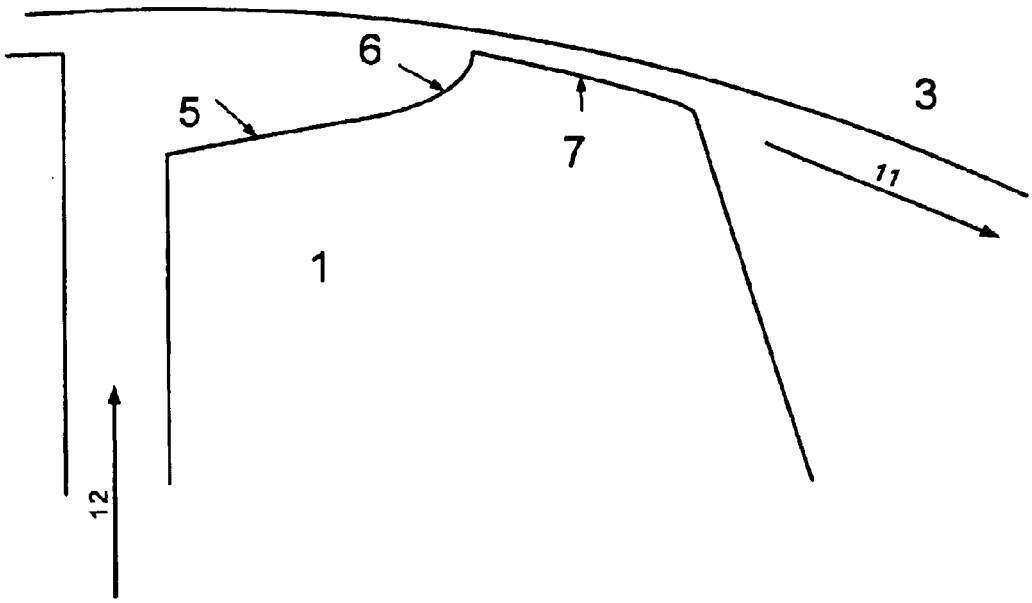

FIG. 4 shows nozzle lip 1, which is in the direction of rotation of the screen, formed as a combination of flat land 5 and upward curve 6, whereby additionally the surface of the lip in the lip/screen contact zone has a curvature 7 of suitable radius matching the curvature of the screen.

EXAMPLE

In a rotary extrusion machine with 1 m width of coating, which is equipped with the usual devices for guiding an endless belt such as roll-off, roll-on path edge controls and path tension measuring systems, and whose coating part comprises a rotating round screen, a nozzle within the screen, and a counter-pressure roller with which the nozzle is pressed to the coating nozzle, a liquid is applied to a strip of material.

| | |
|---|---|
| Viscosity of the liquid | 100 Pas |
| Processing speed | 100 m/min. |
| Weight of the strip of material by area | 130 g/m$^2$ |
| Screen | 40 mesh, hole size 0.3 mm. |

The lip lying in the direction of rotation of the nozzle in use is arranged as follows:

| | |
|---|---|
| Angle between flat land and screen tangent: | 4 degrees |
| length of land: | 6 mm |
| length of rising curve: | 3 mm |
| radius of rising curve: | 50 mm |
| Geometry transverse to direction of rotation: | the same at all points |

With the device and the above process parameters an application coverage of 40 g/m$^2$ can be achieved and the production rate increased form 25 m/min to 100 m/min. The pressure required in the feed system to achieve this application coverage was 0.6 bar. A pressure sensor mounted in the lip as described above sensed a pressure of 6 bar in that area. During a production run of 8 hours, no leakage of any sort was found.

What is claimed is:

1. A method for applying high viscosity liquids to a supporting material, comprising the steps of:

feeding the liquid to a cylindrical screen by means of a nozzle, the geometry of the nozzle being such that a nozzle outlet slit opens into an orifice which feeds the liquid to the screen, whereby an increase of pressure in the liquid is generated in the orifice so that the pressure in the liquid at the nozzle orifice is higher than the pressure in the nozzle outlet slit; and applying the liquid to a supporting material by extruding the liquid through the screen onto the supporting material, wherein the cylindrical screen is rotating in a direction of rotation and the nozzle outlet slit has a lateral edging lip at least in the direction of the rotation of the screen.

2. The method according to claim 1, wherein said applying step comprises extruding the liquid through the screen onto a supporting material which rests on a pressure-resistant substrate.

3. The method according to claim 1, wherein the liquid at the orifice to the outlet slit is accelerated to largely normal to the screen.

4. The method according to claim 1, wherein the face of the lip facing the screen is in the form of a flat land, whereby the land forms an angle to the screen whose vertex lies in the direction of rotation.

5. The method according to claim 4, wherein the angle that the flat land makes with a tangent to the screen at a screen/lip point of contact is between 0.5° and 25°.

6. The method according to claim 4, wherein the angle that the flat land makes with a tangent to the screen at a screen/lip point of contact is between 0.5° and 10°.

7. The method according to claim 4, wherein the surface of the lip facing the screen is a combination of a flat land and a rising curve, whereby the flat land forms an angle to the screen whose vertex lies in the direction of rotation, and the surface of the lip in the direction of rotation following the flat land takes up a rounded curvature matching that of the screen.

8. The method according to claim 7, wherein the ratio of the length of the flat land to the length of the rising curve is between 1:1 and 20:1.

9. The method according to claim 7, wherein the ratio of the length of the flat land to the length of the rising curve is between 3:1 and 10:1.

10. The method according to claim 1, wherein the surface of the lip at the screen/lip point of contact being smoothed into a radius matching the curvature of the screen.

11. The method according to claim 1, wherein the high viscosity liquid at the process temperature has a dynamic null viscosity of 0.1 Pas to 1000 Pas.

12. The method according to claim 1, wherein the high viscosity liquid at the process temperature has a dynamic null viscosity of 1 Pas to 500 Pas.

13. The method according to claim 1, wherein the high viscosity liquid is a solution, a dispersion, a pre-polymer or a thermoplastic polymer.

14. The method according to claim 1, wherein the high viscosity liquid is a melt adhesive.

15. The method according to claim 1, wherein the high viscosity liquid is a melt tack adhesive.

16. A method for applying high viscosity liquids to a supporting material, comprising the steps of:

feeding the liquid to cylindrical screen by means of a nozzle, the geometry of the nozzle being such that a nozzle outlet slit opens into an orifice which feeds the liquid to the screen, whereby an increase of pressure in the liquid is generated in the orifice so that the pressure in the liquid at the nozzle orifice is higher than the pressure in the nozzle outlet slit, and applying the liquid to a supporting material by extruding the liquid through the screen onto the supporting material, wherein the cylindrical screen is rotating in a direction of rotation and the cylindrical screen comprises a heated circular are segment which covers an angle of up to 180° in relation to the center point of the screen and which is arranged on both sides of the point of extrusion of she liquid through the screen in the direction of rotation.

17. The method according to claim 16, wherein the heated circular arc segment covers an angle of 5° to 90° in relation to the center point of the screen.

18. The method according to claim 16, wherein said applying step comprises extruding the liquid through the screen onto a supporting material which rests on a pressure-resistant substrate.

19. The method according to claim 16, wherein the liquid at the orifice to the outlet slit is accelerated to largely normal to the screen.

20. The method according to claim 16, wherein the high viscosity liquid at the process temperature has a dynamic null viscosity of 0.1 Pas to 1000 Pas.

21. The method according to claim 16, wherein the high viscosity liquid at the process temperature has a dynamic null viscosity of 1 Pas to 500 Pas.

22. The method according to claim 16, wherein the high viscosity liquid is a solution, a dispersion, a pre-polymer or a thermoplastic polymer.

23. The method according to claim 16, wherein the high viscosity liquid is a melt adhesive.

24. The method according to claim 16, wherein the high viscosity liquid is a melt tack adhesive.

25. An apparatus for applying high viscosity liquids to a supporting material, comprising:

a nozzle comprising a nozzle outlet slit that opens into an orifice which is capable of feeding a liquid, whereby the nozzle outlet slit and the orifice arc such that an increase of pressure in to liquid is generated in the orifice so that the pressure in the liquid at the nozzle orifice is higher than the pressure in the nozzle outlet slit; and a cylindrical screen through which the liquid fed by the nozzle orifice is applied to a supporting material, wherein the screen is rotatable in a direction of rotation and the nozzle outlet slit has a lateral edging lip at least in the direction of the rotation of the screen.

26. An apparatus for applying high viscosity liquids to a supporting material, comprising:

a nozzle comprising a nozzle outlet slit that opens into an orifice which is capable of feeding a liquid, whereby the nozzle outlet slit and the orifice are such that an increase of pressure in the liquid is generated in the orifice so that the pressure in the liquid at the nozzle orifice is higher than the pressure in the nozzle outlet slit;

a cylindrical screen through which the liquid fed by the nozzle orifice is applied to a supporting material; wherein the screen comprises a heatable circular arc segment which covers an angle of up to 180° in relation to the center point of the screen and which is arranged on both sides of the point of extrusion of the liquid through the screen in the direction of rotation.

* * * * *